US007565853B2

(12) United States Patent
Arnold et al.

(10) Patent No.: US 7,565,853 B2
(45) **Date of Patent: *Jul. 28, 2009**

(54) COMPACT CYCLONIC SEPARATION DEVICE

(75) Inventors: Adrian Christopher Arnold, Brentor (GB); Arthur John Arnold, Okehampton (GB)

(73) Assignee: Euro-Pro Operating, LLC, West Newton, MA (US)

( * ) Notice: Subject to any disclaimer, the term of this patent is extended or adjusted under 35 U.S.C. 154(b) by 917 days.

This patent is subject to a terminal disclaimer.

(21) Appl. No.: 10/926,609

(22) Filed: Aug. 26, 2004

(65) Prior Publication Data

US 2006/0042038 A1 Mar. 2, 2006

(51) Int. Cl.
*A47L 9/10* (2006.01)

(52) U.S. Cl. ..... 81/353; 81/347; 81/350

(58) Field of Classification Search ..... 15/350, 15/347, 353

See application file for complete search history.

(56) References Cited

U.S. PATENT DOCUMENTS

| | | | | |
|---|---|---|---|---|
| 2,678,110 | A | 5/1954 | Madsen | |
| 4,624,691 | A | 11/1986 | Schneider | |
| 5,634,238 | A * | 6/1997 | McCaffrey et al. | 15/353 |
| 5,779,745 | A | 7/1998 | Kilstrom | |
| 5,950,274 | A | 9/1999 | Kilström | |
| 6,192,550 | B1 | 2/2001 | Hamada et al. | |
| 6,195,835 | B1 | 3/2001 | Song et al. | |
| 6,766,558 | B1 | 7/2004 | Matsumoto et al. | |
| 6,782,583 | B2 * | 8/2004 | Oh | 15/350 |
| 7,140,068 | B1 * | 11/2006 | Vander Baan et al. | 15/347 |
| 2003/0121121 | A1 | 7/2003 | Nakai et al. | |
| 2004/0074213 | A1 | 4/2004 | Organ | |

FOREIGN PATENT DOCUMENTS

| | | |
|---|---|---|
| EP | 1 042 981 A2 | 10/2000 |
| WO | WO 99/42198 | 8/1999 |
| WO | WO 02/069778 A1 | 9/2002 |

* cited by examiner

*Primary Examiner*—Joseph J Hail, III
*Assistant Examiner*—Shantese McDonald
(74) *Attorney, Agent, or Firm*—McCarter & English, LLP; Michael I. Wolfson

(57) ABSTRACT

A cyclonic separation device for a vacuum cleaner including a cylindrical separation container, an inlet tube parallel to the axis of the chamber having a vortex vane disposed axially in the inlet tube. Air rotates in one direction in the inlet tube, and preferably in the opposite direction in the separation chamber tube. The separation chamber includes a cylindrical sidewall with an upper central outlet tube and a closed bottom for collecting separated dirt. A disrupter ring located on the inside wall of the middle portion of the separation chamber includes a curved surface and sharp edge for lifting air flow off the chamber wall. A outlet tube disc spaced from the inlet of the outlet tube is located in the chamber below the disrupter ring.

15 Claims, 7 Drawing Sheets

COMPACT CYCLONIC SEPARATION DEVICE

BACKGROUND OF THE INVENTION

The invention relates to a cyclonic separation device for a vacuum cleaner. More particularly, it relates to a cyclonic separation attachment to be placed on the inlet pipe between the vacuum nozzle and the handle of the inlet pipe to increase the dirt separation and collection of a vacuum cleaner having a rigid inlet pipe.

Cyclonic separating devices for vacuum cleaners have been known for some time. For example, U.S. Pat. No. 6,195,835 to Samsung Kwangju Electronics discloses a vacuum cleaner having a cyclone dust collecting device. Here, the cyclone dust collecting device includes a dirt separating cyclonic chamber with a shroud extending into the chamber having a plurality of holes of a size to prevent the dirt of a predetermined particle size from flowing into the air outlet.

Another example of a cyclonic separation device is disclosed in U.S. Pat. No. 5,950,274 to Aktiengesellschaft Electrolux. The cyclonic separator includes a separation chamber having an upper cylindrical portion and a lower inverted truncated cone which defines a whirl chamber. Dirty air enters the interior of the cylindrical portion and travels down the truncated conical portion before exiting the top. The upside down truncated cone has a lower opening for dirt particles to fall through to be collected in the dirt collecting chamber below.

While the use of either cyclonic separators provides its own advantage, considerations related to the configuration of the vacuum cleaner as a whole may also affect the viability of the design. As the size of the vacuum cleaners becomes smaller and more compact, it becomes increasingly difficult to prevent the air flow from progressing down the inside of the separation chamber from disturbing the dirt collected in the dirt collecting container. This appears to be the reason why the collection chambers in both of the devices described above are relatively elongated. The extended collection chambers enables the air flow to disperse naturally and return to the exhaust without significant re-entrainment. Further, the separation chamber must be removable to allow it to be emptied, cleaned or replaced for the ease of use.

Thus, while these designs represent an improvement in separation of conventional vacuums utilizing bag technology, it remains desirable to provide continued improvements and alternative designs to improve the separation of dirt particles from air in an air separation attachment for a vacuum cleaner.

SUMMARY OF THE INVENTION

Generally speaking, in accordance with the invention, a cyclonic separation attachment for a vacuum cleaner having a compact separation chamber with an inlet opening and an inlet tube with a vane assembly is provided. The vane assembly attachment includes a vertical inlet tube with a vortex vane upstream of the substantially cylindrical separation chamber. A central outlet tube assembly extends into the upper portion of the separation chamber. The separation chamber includes a decoupling or disrupter ring located on the inside wall at the middle of the separation container. A outlet tube disc is suspended from the bottom of the outlet tube and is positioned below the level of disrupter ring. The lower portion of the separation chamber collects the dirt and has an openable bottom for the removal of separated dirt.

Accordingly, it is an object of the invention to provide an improved cyclonic dirt separation attachment for a vacuum cleaner.

It is another object of the invention to provide a cyclonic separation attachment having a small and compact separation chamber for mounting on the inlet pipe of a vacuum cleaner.

A further object of the invention is to provide a cyclonic separation attachment having a cylindrical separation chamber that includes a disrupter ring for lifting air off the interior wall of the separation chamber.

Yet another object of the invention is to provide a cyclonic separation attachment having a outlet tube disc spaced apart from a central outlet tube to prevent re-entrainment of separated dirt into the air stream exiting the separation chamber.

Still a further object of the invention is to provide a cyclonic attachment with a cylindrical separation chamber for a mounting or an inlet pipe of a vacuum cleaner having a vortex vane in an inlet tube disposed parallel to the cylindrical separation chamber that imparts spin to the inlet dirt laden air.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE INVENTION

Figure 1:
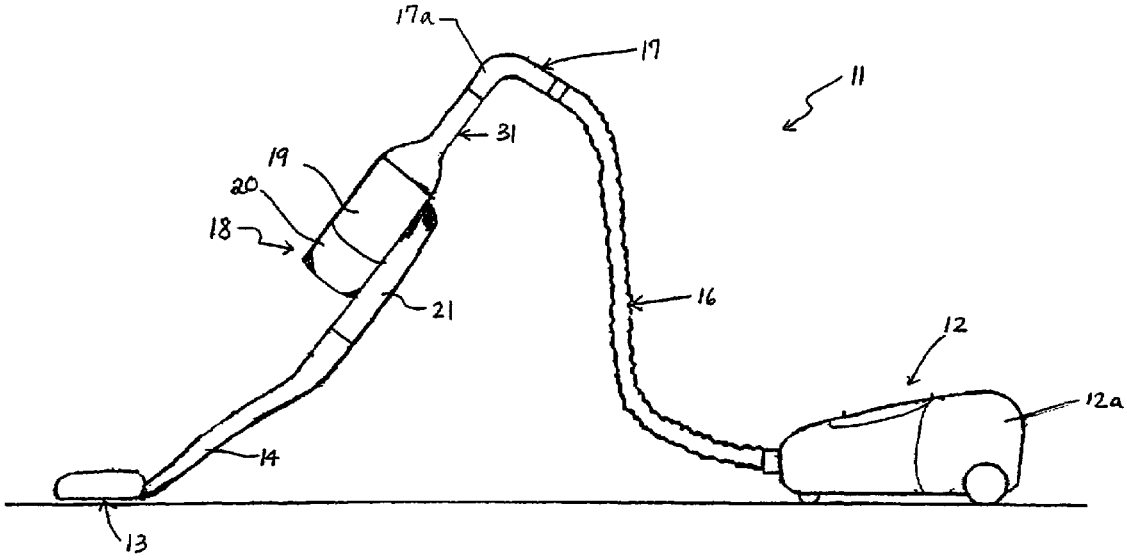
FIG. 1 is a side elevation view of a vacuum cleaner with a removable cyclonic separation device constructed and arranged in accordance with the invention.

FIG. 1 illustrates a vacuum cleaner 11 having a canister housing 12 including a vacuum source 12*a*, and a floor nozzle dirt collector 13 connected to a rigid vacuum handle 17. A flexible hose 16 connects canister 12 to rigid vacuum handle 17 having a pipe section 17*a*. A cyclonic separation device 18 constructed and arranged in accordance with the invention is mounted between nozzle pipe 14 and vacuum handle tube section 17*a*.

Cyclonic device 18 has a substantially cylindrical separation chamber 19 and collection chamber 20 with a rigid inlet tube 21 and an outlet tube 31. Dirt laden air from nozzle 13 is fed to separator chamber 19. Exhaust air exits chamber 19 through outlet tube 31.

Figure 2:
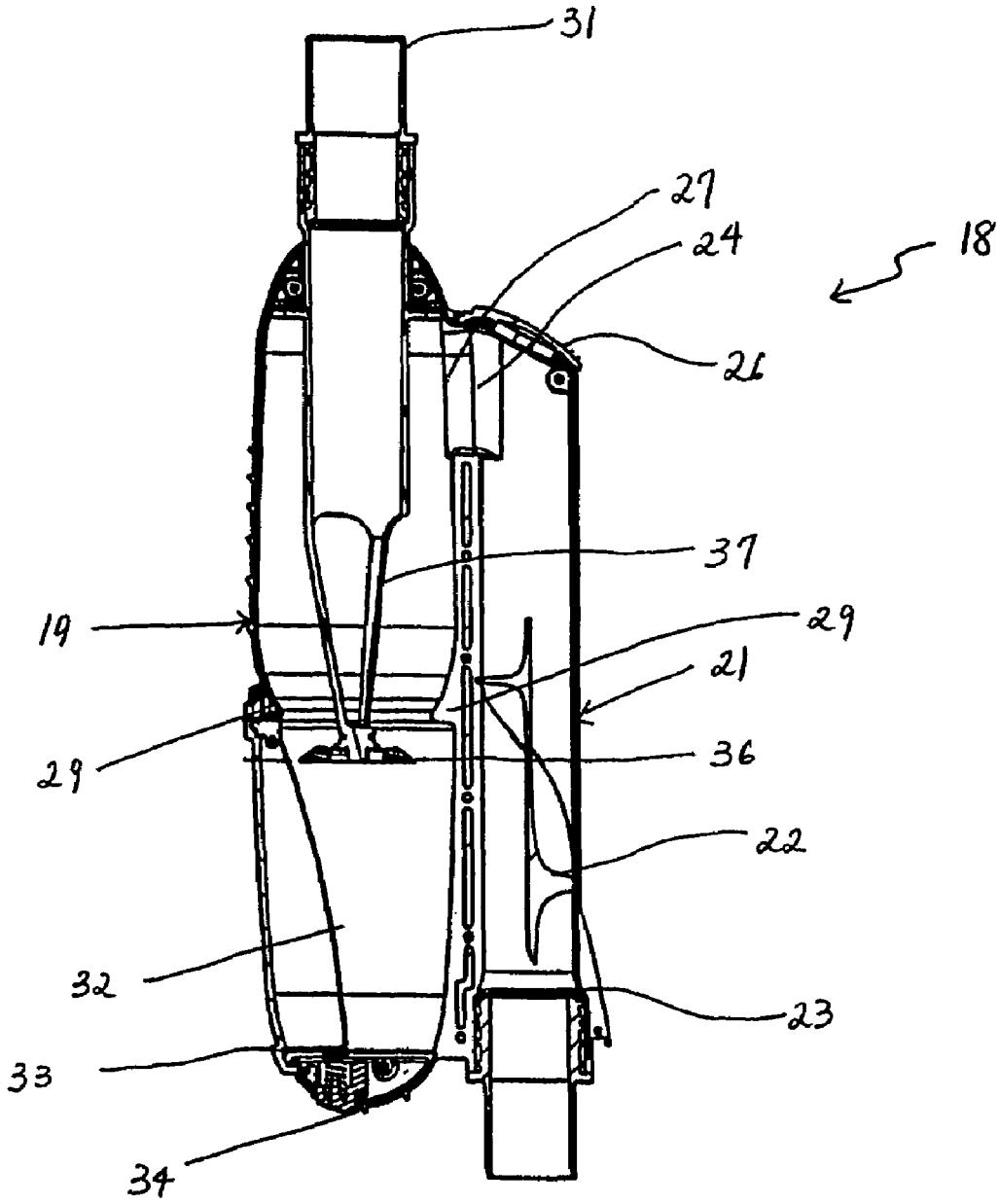
FIG. 2 is a cross-sectional view of the cyclonic separation device with disrupter ring, tube disk and inlet vortex vane of FIG. 1 constructed and arranged in accordance with the invention.

As shown in more detail in the cross-sectional view of FIG. 2, cyclonic separation attachment 18 includes a vortex vane 22 in inlet tube 21. Inlet tube 21 is adjacent to and parallel to cylindrical separation chamber 19 and has an inlet opening 23 and an outlet opening 24 leading into separation chamber 19 through a transfer region 27 between inlet tube 21 and separation chamber 19. A cap 26 is hingedly connected to the top of inlet tube 21 to allow an user to remove any dirt on vane 22 in inlet tube 21.

Figure 3:
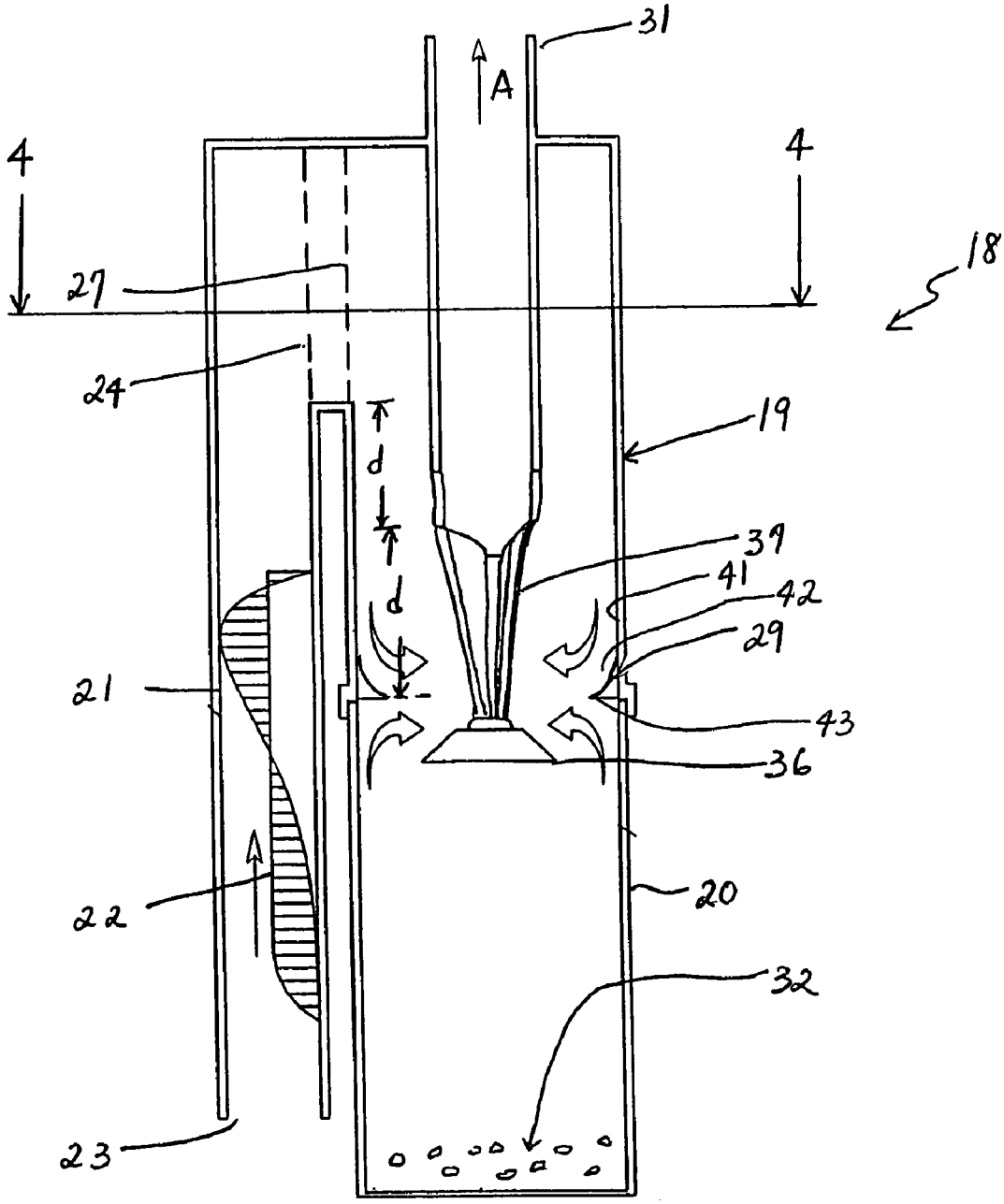
FIG. 3 is a cross-sectional view in schematic showing the air-flow pattern in the inlet and separation chamber.

FIG. 3 shows the air-flow pattern in inlet tube 21 and cylindrical separation chamber 19. Vortex vane 22 causes air that enters to rotate axially in inlet tube 21. This forces the dirt particles in the air to move by centrifugal force towards the wall of inlet tube 21 while simultaneously being carried up towards transfer region 27. This allows the dirt particles to leave inlet tube 21 in a thin layer which then goes through transfer region 27 and into separation chamber 19 as smoothly as possible. This reduces the amount of turbulence which can cause agglomerated dirt particles to dissociate and reduce efficiency.

In one embodiment of the invention, vortex vane 22 is an elongated sheet that extends axially within inlet tube 21 and is twisted, but does not cross inlet tube 21. Vane 22 progresses gradually to present a final angle of approximately 60° to the axis at outlet opening 24 of the inlet tube 21 after completing a full 360° turn. While a 60° angle is preferred, the angle may vary from 45° to 75°. In this manner, the pressure loss in attachment 18 is kept as low as possible while maintaining maximum angular motion.

Separation chamber 19 and collection chamber 20 form a substantially cylindrical chamber with transfer region 27 leading from outlet opening 24 of inlet tube 21 connecting to the upper portion of separation chamber 19. Dirt in inlet tube 21 is ejected into separation chamber 19 in a direction that ensures that it meets the inner wall of separation chamber 19 in a tangential direction for collection in collection chamber 20. Preferably, this is in the opposite direction of rotation than air rotating in inlet tube 21 as it passes over vortex vane 22.

Separation chamber 19 also has a decoupler/disrupter ring 29 located on the inside wall at the bottom of separation chamber 19. The length of separation chamber 19 and thus the disrupter ring 29 is about the same distance as the distance from the bottom of transfer region 27 to the bottom of outlet tube 31 shown as the length d. This length need not be exact, but can vary by as much as plus or minus 25%.

Disrupter ring 29 is curved or is a frusto-ovoid shape to force the air flow to break away from the inner wall of chamber 19. When vacuum source 12*a* in canister 12 is on, air is drawn from chamber 19 through upper conduit outlet tube 31 extending into chamber 19 and connected to rigid handle 17. This allows cleaned air to be drawn axially up the upper portion of separation chamber 19 along an arrow A to vacuum canister 12 and is collected therein. As the cleaned air is drawn up outlet tube 31, dirt 32 falls into the lower portion of chamber 19. An openable bottom 33 is hingedly mounted to dirt collection chamber 20 with a release button 34 to facilitate the removal of collected dirt 32.

Collection chamber 20 should be at least 50 percent of the length of separation chamber 19 and preferably of equal length or 50 percent longer. Too short a length will cause dirt 32 to collect too fast and require emptying too often. Separation chamber 19 also includes a outlet tube disc 36 that is located on the axis of chamber 19 below the opening to outlet tube 31 and below the height of disrupter ring 29. In this embodiment of the invention outlet tube disc 36 is suspended from the lower open end of outlet tube 31 by a plurality of ribs 37. Outlet tube disc serves to limit turbulence in the lower portion of separation chamber 19 and prevent re-entrainment of dirt collected on bottom into outlet tube 31. In the illustrated embodiment of the invention, outlet tube disc 36 is positioned below disrupter ring 29 a distance about equal to the width of transfer region 27 shown by a width w in FIG. 4A for maximum effectiveness. By doing this any dirt or debris that passes through transfer region 27 can pass by outlet tube disk 36 and fall in collection chamber 20.

Figure 4A:
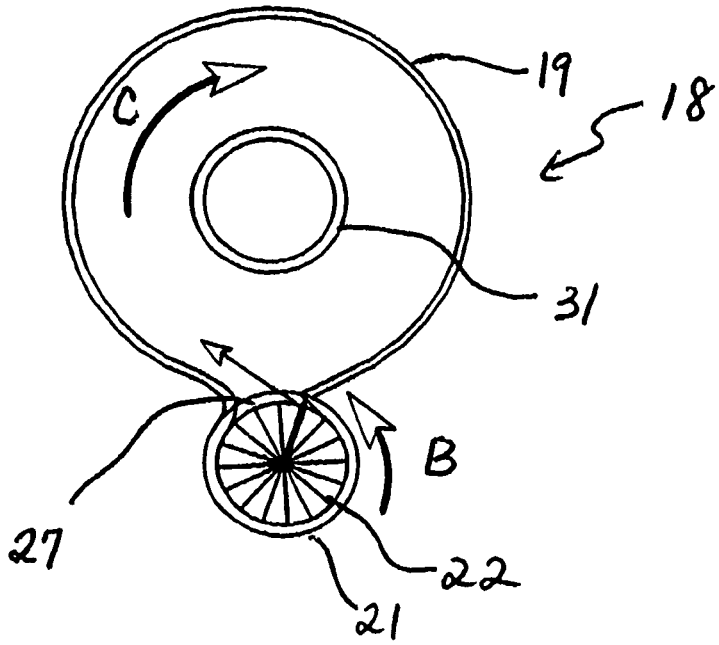
FIGS. 4A and 4B are cross-sectional views of the cyclonic separation attachment showing the dirt-laden air flow pattern in the cyclonic device of FIG. 3 taken along line 4-4.
Figure 4B:
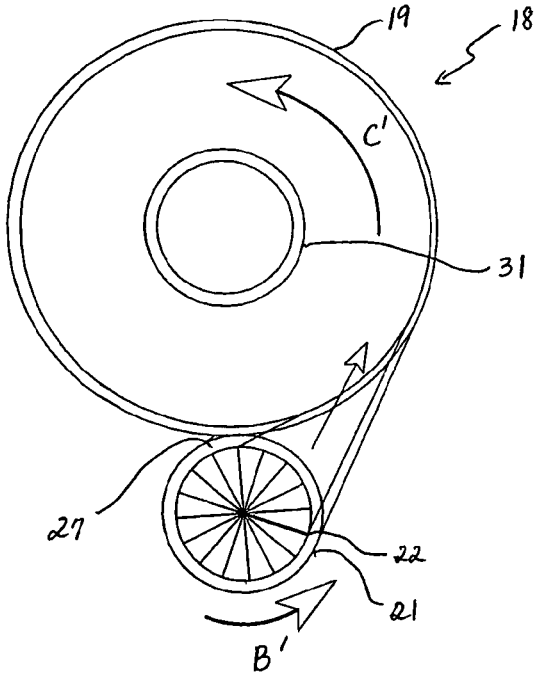

FIGS. 4A and 4B are top cross-sectional views of the cyclonic separation device 18 that shows the direction of the rotation of air flow. In FIG. 4A an arrow B shows incoming air flow in inlet tube 21 to be in a counter-clockwise direction. This airflow is reversed in separation chamber 19 as shown by an arrow C after passing through. It is also possible to arrange the outlet opening of inlet tube 21 at transfer region 27 so that air flow can be maintained in the same direction in the inlet tube 21 and the separation chamber 19 as shown in FIG. 4B. Here, incoming air rotates in a counter-clockwise direction shown by an arrow B' and in separation chamber 19 as shown by an arrow C'.

Figure 5:
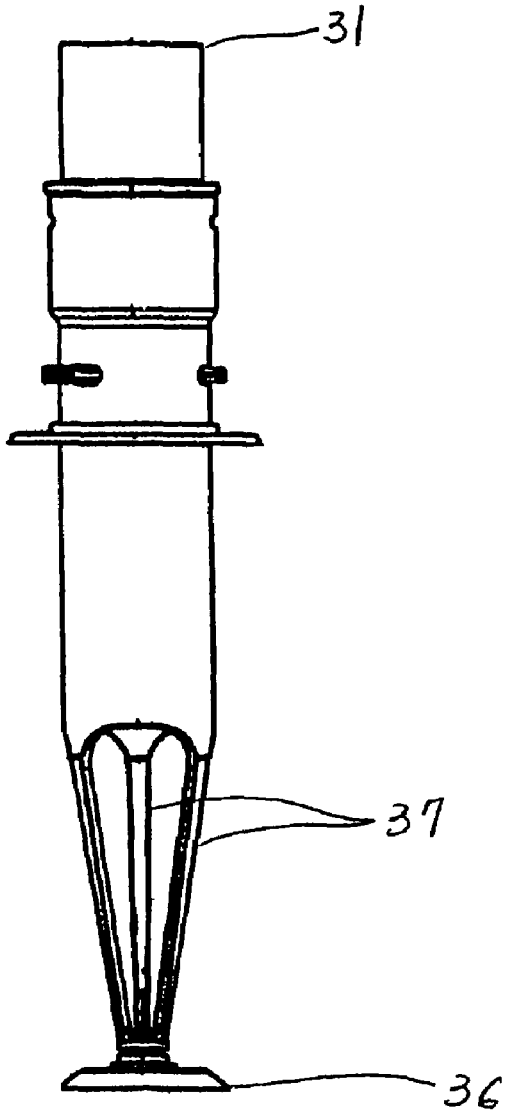
FIG. 5 is a side elevation view of the outlet tube disc of FIG. 2 showing the outlet tube disk suspended by ribs constructed and arranged in accordance with the invention.
Figure 6:
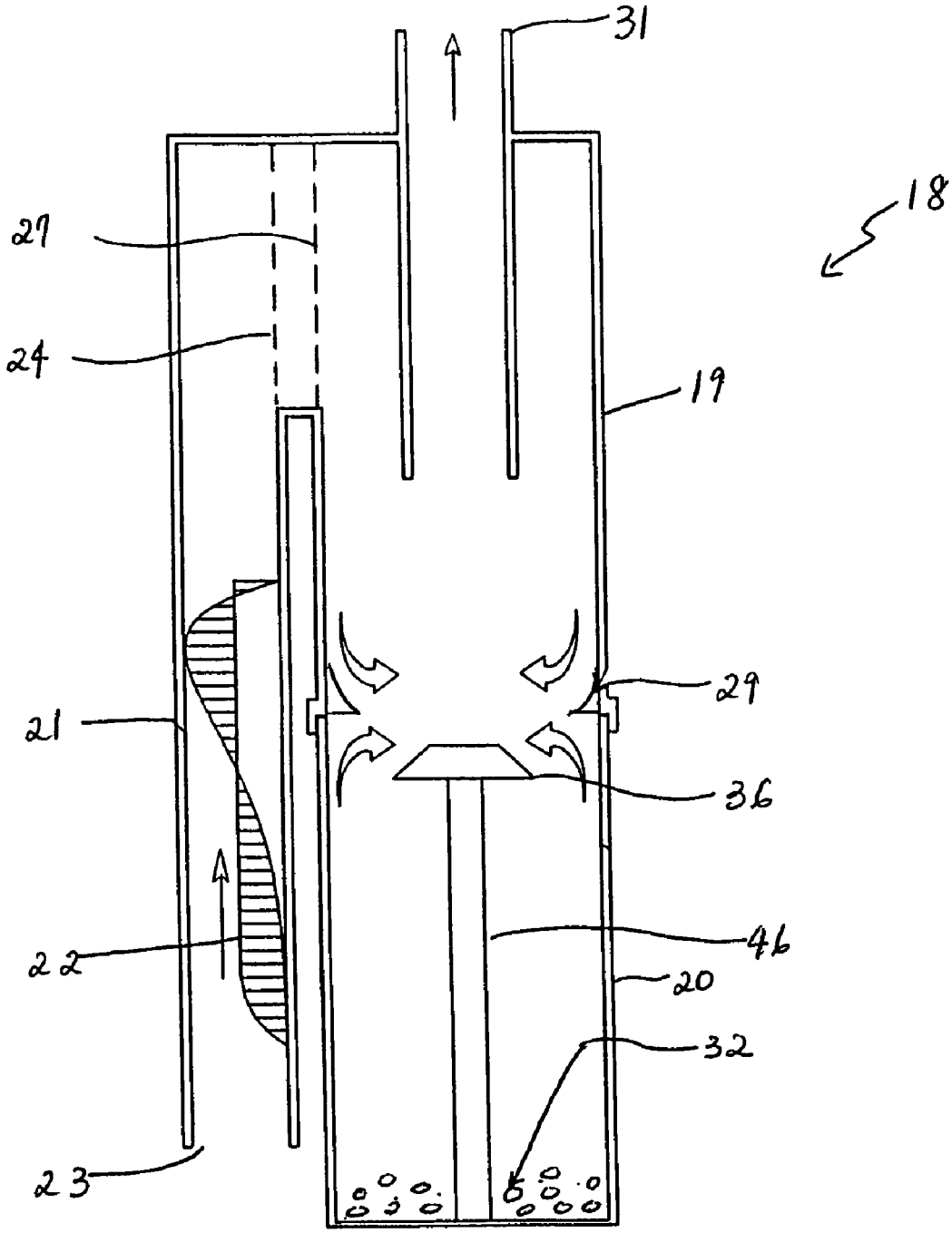
FIG. 6 is a cross-sectional view of a cyclonic separation device in schematic with an outlet tube mounted on a post fixed to the bottom constructed and arranged in accordance with an alternative embodiment of the invention.

FIG. 5 illustrates the embodiment wherein an outlet tube disc 36 is suspended from the lower open end of outlet tube 31 by ribs 37. Outlet tube disc limits turbulence in the lower portion of separation chamber 19 and prevents re-entrainment of dirt collected on bottom into outlet tube 31. In an alternative embodiment, an outlet tube disc 46 is supported by a stem 47 which is attached to the bottom of separation chamber 19 as illustrated in FIG. 6. Here, dirt-laden air is introduced and dirt is separated in the same manner as in the embodiment illustrated in FIG. 2.

Figure 7:
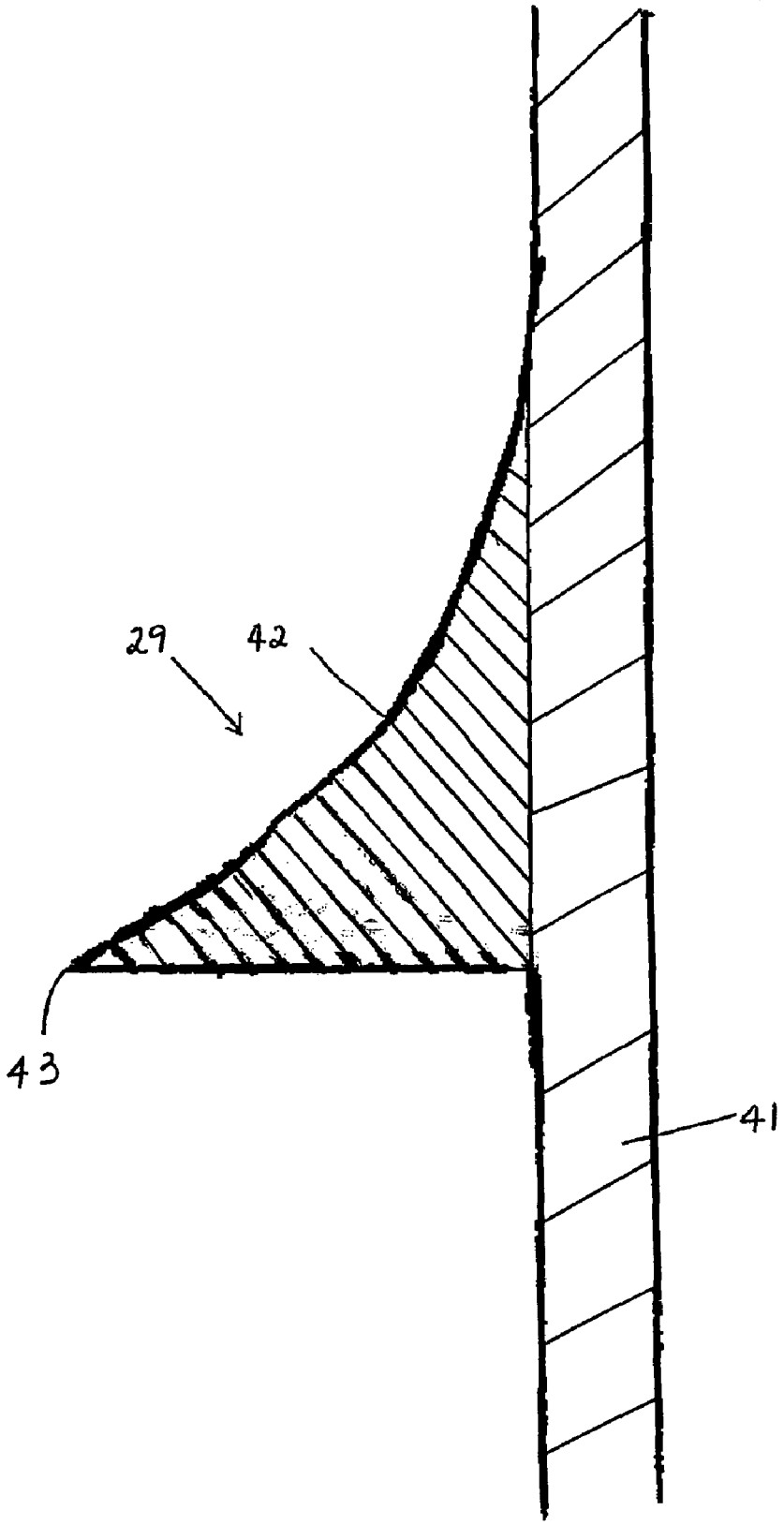
FIG. 7 is a partial cross-sectional view showing the shape of a disrupter ring in accordance with the invention.

Referring now to FIG. 7, disrupter ring 29 is shown in a detailed cross-section view. Ring 29 extends inwardly from sidewall 41 in a gradual arc or curved surface 42 extending outwardly to a relatively sharp edge 43. The shape shown is frusto-ovoid. This insures separation of air flow from wall 41. Disrupter ring 29 may be other shapes than frusto-ovoid. It may be a flange with sharp defined edges. However, in this case dirt may tend to collect at the inner regions of the crease at sidewall 41 and ultimately present the smooth arc shape to the air flow in FIG. 7. Ring 29 should extend inwardly about 10 to 20 percent of the diameter of cylindrical chamber 19.

It will thus be seen that the objects set forth above, among those made apparent from the preceding description, are efficiently attained and, since certain changes may be made in the above construction(s) without departing from the spirit and scope of the invention, it is intended that all matter contained in the above description or shown in the accompanying drawings(s) shall be interpreted as illustrative and not in a limiting sense.

It is also to be understood that the following claims are intended to cover all of the generic and specific features of the invention herein described and all statements of the scope of the invention that as a matter of language, might be said to fall there between.

What is claimed is:

1. A cyclonic separation device for a vacuum cleaner operatively connected to a vacuum source, comprising:

a cylindrical separation chamber having a central axis, an inlet at the upper portion, an outlet at the top and a closed bottom;

an inlet tube having an inlet opening and outlet opening positioned adjacent the separation chamber with an axis of the inlet tube substantially parallel to the central axis of the separation chamber;

a vortex vane positioned in the inlet tube causing inlet air to circulate axially;

a transfer region adjacent to the outlet opening of the inlet tube connected to the upper portion of the separation container for introduction of axially circulating air into the separation chamber; and a central outlet tube having an inlet in the separation chamber and an outlet communicating with the vacuum source.

2. The cyclonic separation device of claim 1, further including:

a disrupter ring located on the full circumference of the inside wall of the separation chamber at a position below the inlet of the outlet tube.

3. The cyclonic separation device of claim 2, including an outlet tube disc positioned below the inlet to the outlet tube at a level below the disrupter ring.

4. The cyclonic separation device of claim 3, wherein the central outlet tube extending into the separation chamber and the outlet tube disc is supported by ribs attached to the inlet of central outlet tube.

5. The cyclonic separation device of claim 3, wherein the outlet tube disc is supported in the middle region of the separation chamber by a stem attached to the bottom of the separation container.

6. The cyclonic separation device of claim 3, wherein the outer diameter of the outlet tube disc extends to between about 40 to 75 percent of the diameter of the separation container.

7. The cyclonic separation device of claim 2, wherein the disrupter ring extends inwardly into the separation chamber between about 3 to 15 percent of the diameter of the chamber.

8. The cyclonic separation device of claim 1, wherein the inlet tube has an openable cleanout cap at the outlet end of the inlet tube.

9. The cyclonic separation device of claim 1, wherein the vortex vane in the inlet tube progresses gradually from a first position at the inlet opening of the inlet tube to the outlet opening of the inlet tube where the guiding vane is between about 45° to 75° from the first position, after having completed a 360° rotation within the inlet tube.

10. The cyclonic separation device of claim 9, wherein the guiding vane is about 60° from the first position.

11. The cyclonic separation device of claim 1, wherein the bottom is selectively openable for removal of dirt collected on the bottom.

12. The cyclonic separation device of claim 1, wherein the vortex vane rotates incoming air in a first direction and air is fed into the separation chamber in an opposite direction.

13. The cyclonic separation device of claim 1, wherein the vortex vane rotates incoming air in a first direction and air fed into the separation chamber in the same direction.

14. A vacuum cleaner including a cyclonic separation device disposed between a vacuum source and a nozzle, the cyclonic separation attachment comprising:

a cylindrical separation chamber having a central axis, an inlet at the upper portion, an outlet at the top and a closed bottom;

an inlet tube having an inlet opening and outlet opening positioned adjacent the separation chamber with an axis of the inlet tube substantially parallel to the central axis of the separation chamber;

a vortex vane positioned in the inlet tube causing inlet air to circulate axially;

a transfer region adjacent to the outlet opening of the inlet tube connected to the upper portion of the separation container for introduction of axially circulating air into the separation chamber; and a central outlet tube having an inlet in the separation chamber and an outlet communicating with the vacuum source.

15. The cyclonic separation device of claim 14, further including:

a disrupter ring located on the full circumference of the inside wall of the separation chamber at a position below the inlet of the outlet tube.

* * * * *